US006401516B1

(12) United States Patent
Herndl et al.

(10) Patent No.: US 6,401,516 B1
(45) Date of Patent: Jun. 11, 2002

(54) HYDRAULIC DRIVE SYSTEM FOR FORGING PRESS OR FORGING MACHINE SLIDES

(75) Inventors: Otto Herndl, Odenthal; Albert Eck, Wipperfürth; Dieter Volksheimer, Leverkusen, all of (DE)

(73) Assignee: SMS Eumuco GmbH, Leverkusen (DE)

( * ) Notice: Subject to any disclaimer, the term of this patent is extended or adjusted under 35 U.S.C. 154(b) by 0 days.

(21) Appl. No.: 09/486,915

(22) PCT Filed: Oct. 8, 1998

(86) PCT No.: PCT/DE98/02975

§ 371 (c)(1),
(2), (4) Date: Mar. 1, 2000

(87) PCT Pub. No.: WO99/19096

PCT Pub. Date: Apr. 22, 1999

(30) Foreign Application Priority Data

Oct. 15, 1997 (DE) ..... 197 45 505

(51) Int. Cl.[7] ..... B21J 9/12

(52) U.S. Cl. ..... 72/453.18; 72/453.01; 72/402

(58) Field of Search ..... 72/453.01, 453.14, 72/453.18, 402, 403, 441

(56) References Cited

U.S. PATENT DOCUMENTS 2,744,315 A * 5/1956 Fitzgerld ..... 72/453.18
3,916,667 A * 11/1975 Paknke et al. ..... 72/402
3,948,148 A * 4/1976 Bringer ..... 91/49
4,941,342 A * 7/1990 Herndl et al. ..... 72/453.18

* cited by examiner

*Primary Examiner*—David Jones
(74) *Attorney, Agent, or Firm*—Herbert Dubno

(57) ABSTRACT

The invention relates to a hydraulic drive system for the tool-bearing slide of a forging press or a forging machine. The slide is configured as a piston and is provided with a valve seat at the opposite end of the tool, that is, the end which is impinged upon by pressure means. Together with a valve lifter driven by an actuator, said valve seat forms a valve which is able to connect the cylinder chamber to a pressureless discharge pipe and therefore control the stroke of the piston. In order to reduce the mass and the axial construction length of the inventive drive system, the piston is hollow over a portion of its length from the end which is impinged upon, and is provided with the valve seat at the base of the hollow. The valve lifter, which can be axially displaced in the cylinder lid, is tubular in shape and is provided with side channels connecting its inner cavity to a pressureless discharge pipe for the pressure means.

4 Claims, 2 Drawing Sheets

HYDRAULIC DRIVE SYSTEM FOR FORGING PRESS OR FORGING MACHINE SLIDES

CROSS REFERENCE TO RELATED APPLICATIONS

This application is a national stage of PCT/DE98/02975 filed Oct. 8, 1998 and is based upon German national application 197 45 505.0 filed Oct. 15, 1997 under the International Convention.

FIELD OF THE INVENTION

The invention relates to a hydraulic drive for slides of a multiple-slide forging machines as known from DE-C2 38 03 632.

BACKGROUND OF THE INVENTION

The slides of such a forging machine, each bearing a tool, are built as pistons which, at their end opposite to the tool acted upon by a pressure medium, are provided with a valve seat connected to a central throughflow bore, which via side channels is connected to a chamber kept pressureless by means of a discharge line. A valve lifter controlled by an actuator cooperates with the valve seat on the piston and controls the piston stroke. The pistons are designed as differential pistons and are constantly acted upon by the pressure medium at their piston ring surface in the pull-back direction. This drive system is characterized by its good dynamics and simple construction.

Because of its good dynamics, this drive system is well suited for use in high-speed forging presses, which as a replacement of forging hammers, should reach 180 to 240 strokes per minute. The problem here is that forging presses have to be laid out for substantially bigger strokes than the relatively short-stroke forging machines, whereby the axial length of the drive system and the slide mass increase correspondingly.

OBJECT OF THE INVENTION

It is the object of the invention to improve the drive system known from DE-C2 38 03 632 rendering it applicable to high-speed forging presses.

SUMMARY OF THE INVENTION

In order to solve this problem a reduction of the axial length of the drive system with the reduction of its mass is targeted, which is achieved by making the piston partially hollow starting from its end opposed to the tool. On the bottom of the hollow is the valve seat. The valve lifter is tubular in shape and guided so as to be axially displaceable in the cylinder lid and is provided with side channels in the cylinder lid connecting the inner space of the valve lifter with a chamber surrounding the valve lifter kept without pressure via a discharge line.

In order to achieve this object of the invention aimed at the reduction of the axial length of the drive system, according to another feature of the invention, it is further developed in an embodiment in which the differential piston step is eliminated.

The piston is built as a plunger piston which at its tool end is connected with a tool-bearing upper plate/front plate, which by means of guide rods is guided in the traverse. The return stroke of the plunger piston is performed by means of the piston-cylinder units supported in the traverse.

Four guide rods are preferably provided which are connected in pairs above the traverse by yoke pieces and between the same and the traverse the piston-cylinder units are arranged for the pull-back.

During the forging operations the pull-back pistons are constantly acted upon from an accumulator to keep them inactive.

SPECIFIC DESCRIPTION

Figure 1:
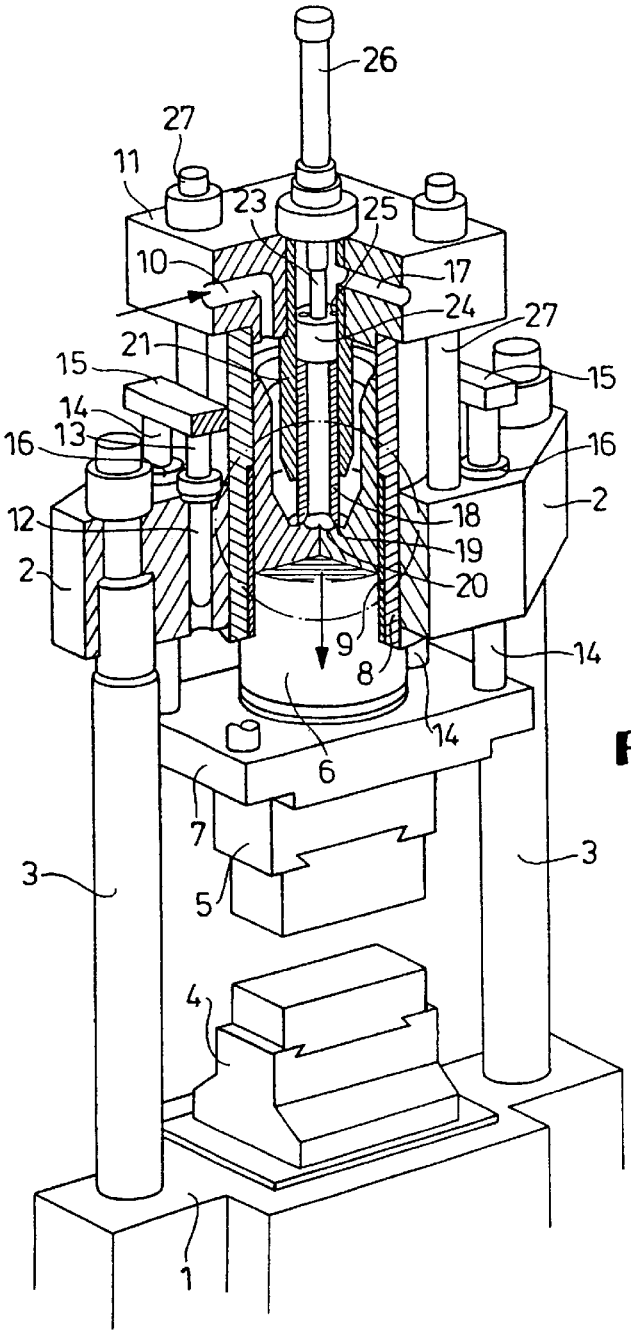
FIG. 1 is a perspective view of a forging press, partially sectioned.
Figure 2:
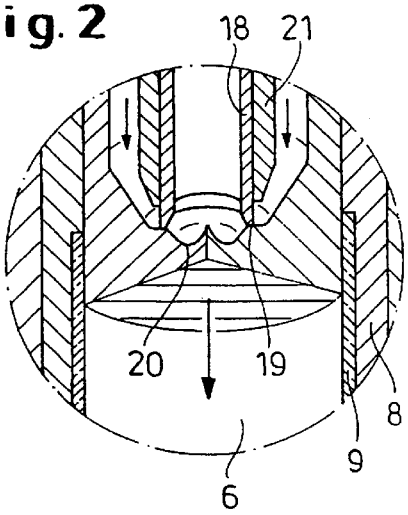
FIG. 2 is a cutout during the work stroke.
Figure 3:
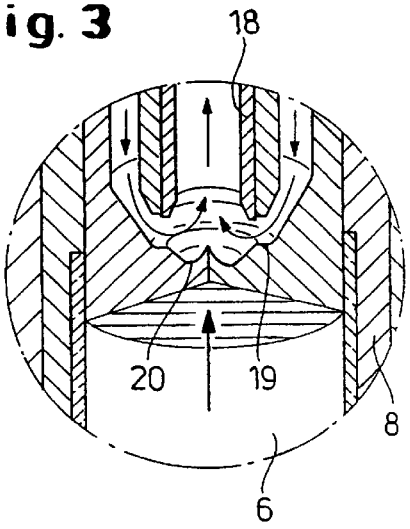
FIG. 3 is the same cutout during the return stroke.

The forging press consists of a stationary lower traverse 1, an upper traverse 2 which is also stationary and the columns 3 connecting the same. The traverse 1 carries a lower saddle 4 opposed by an upper saddle 5. The upper saddle 5 is moved by a piston 6 connected to an upper plate 7 to which the upper saddle 5 is fastened. A cylinder 8 guiding the piston 6 is securely mounted in the upper traverse 2 and provided with a bushing 9 for the guidance of the piston 6. For the work stroke the piston 6 is actuatable in the cylinder 8 by a pressure-medium supply line 10 in the cylinder lid 11. The cylinder 8 and the cylinder lid 11 are connected with the upper traverse 2 by means of traction anchors 27. For the return stroke, pull-back cylinders 12 with plunger pistons 13 are provided, whereby the retraction or pull-back cylinders 12 are supported in the upper traverse 2 and the plunger pistons 13 act against yokes 15. Preferably the plunger pistons 13 in the retraction or pull-back cylinders 12 are constantly acted upon from a low-pressure tank not shown in the drawing.

In a variation of the embodiment shown, piston-cylinder units can be provided for the pull-back, whose cylinders are fastened in the upper traverse 2 and from whose piston rods the upper plate 7 is suspended. Also instead of the retraction cylinder, a construction of the piston 6 and the cylinder 8 as a double-action piston-cylinder unit can be provided, whereby the ring surface on piston 6 provided for the pullback is then constantly actuated.

For the guidance of the upper plate 7, the same is provided with guide rods 14, which at their free ends are connected by yokes 15 and are guided by bushings 16 in the upper traverse 2. For the pressure medium subjected to pressureless discharged during standstill and pullback, a discharge line 17 is provided in the cylinder lid 11.

The press stroke is controlled by a valve lifter 18 which cooperates with a seat surface 19 on the bottom of the partially hollow piston 6. The valve lifter 18 is guided in a hollow pin 21. The valve lifter 18 is hollow and provided with side channels 25 for the pressureless medium at its head end 24 designed for the connection with rod 23. A piston-cylinder unit 26 is provided as a member of a servocontrol and connected elastically bendable via the rod 23 with the valve lifter 18.

For the work stroke the valve lifter 18 is pressed down by the piston-cylinder unit 26 onto the valve seat 19, whereby the piston 6 and the valve lifter 18 travels together during the downward stroke. When the desired forge dimension is reached, the piston of the piston-cylinder unit 26 is reversed, i.e. actuated upwards via the servocontrol, whereby the valve lifter 18 moves away from the valve seat 19. Through this opening of the valve the work pressure over piston 6 is reduced, in that the pressure medium is discharged through the hollow lifter 18, the side channels 25 in the head 24 of the valve lifter 18 and finally through the discharge line 17, so that the piston 6 comes to a standstill after the decompression of the pressure medium. At a further opening of the valve, the upper forging tool with the upper plate 7 and the piston 6 is lifted by the plunger piston 13 of the retraction cylinders 12 by means of the yokes 15 and the guide rods 14.

Figure 4:
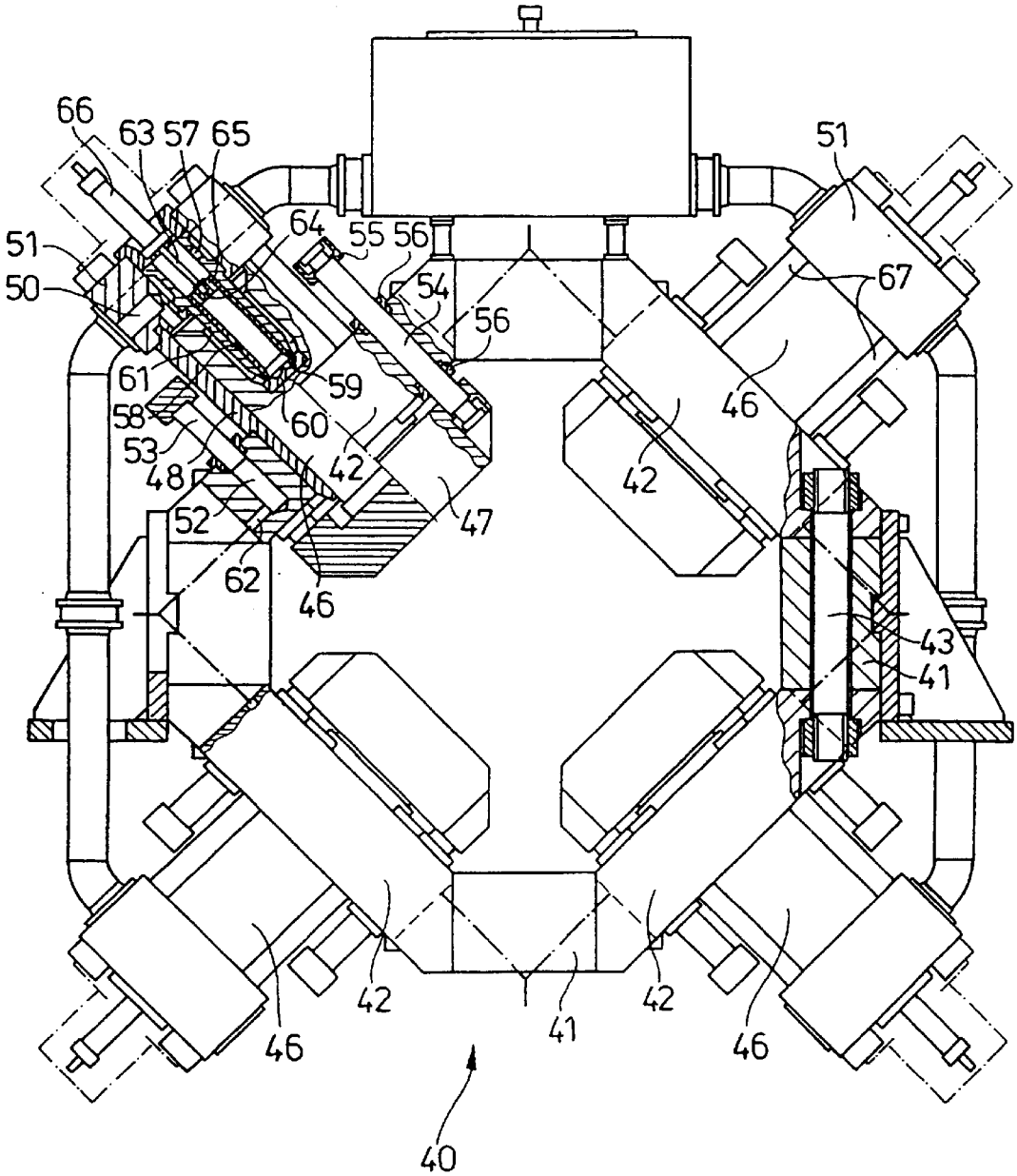
FIG. 4 is an elevational view of a forging machine, partially in section.

The forging machine shown in FIG. 4 has four forging tools arranged in one plane in an X-shape. It consists of a frame 40, composed of intermediate pieces 41 and traverses 42, interconnected by traction anchors 43. In each of the four traverses 42 there is a piston 46 serving as a slide, provided with a front plate 47, a not illustrated tool being releasably connected with the same. Each piston 46 is guided in a cylinder 48 which is inserted in its traverse 42. For the work stroke, each piston 46 can be actuated in its cylinder 48 via a pressure-medium supply line 50 in the cylinder lid 51. In each instance a cylinder 48, a cylinder lid 51 and a traverse 42 are connected by traction anchors 67. For the return stroke, retraction cylinders 52 with plunger pistons 53 are provided, whereby the retraction cylinder 52 is supported in the traverses 42 and the plunger pistons 53 act against the yokes 55, which are connected via guide rods 54 with the front plate 47 of the pertaining piston 46. The plunger pistons 53 are constantly actuated in the retraction cylinders 52 via pressure-medium supply lines 62 from a not illustrated low-pressure storage tank. For the pressure medium discharged without pressure during the return stroke and standstill of the pistons 46, a discharge line 47 is provided in the cylinder lid 51.

For their guidance the front plates 47 are provided with guide rods 54. which at their free ends are connected with the yokes 55 and are guided by bushings 56 in the pertaining traverse 42.

The stroke of the pistons 46 is controlled by valve lifters 58, which cooperate with seat surfaces 59 on the bottoms 60 of the pistons 46 which are hollow over a portion of their length. Each valve lifter 58 is guided in a hollow pivot 61 connected with the cylinder lid 51 of the pertaining cylinder 48. The valve lifters 58 are hollow and provided with side channels 65 for the pressureless pressure medium at their head end 64 designed for the connection with the rods 63. Each valve lifter 58 is connected elastically bendable via rods 63 with a piston-cylinder unit 66 as member of a servocontrol. For the work stroke the valve lifters 58 are pressed down onto their valve seats 59 by the pistons of the piston-cylinder units 66, whereby the pistons 46 and the valve lifters 58 travel together over the stroke path. When the control-determined stroke path has been completed, through the servocontrol the piston of the piston-cylinder unit 66 is acted upon in the opposite direction, whereby the pertaining valve lifter 58 is moved away from its valve seat 59. Due to this opening of the valve formed by the valve lifter 58 and the valve seat 59, the work pressure is reduced over the respective piston 46, in that the pressure medium is discharged via the hollow valve lifter 58 and the side channels 65 in the head end 64 and finally through the discharge line 57, so that the piston 46 comes to a standstill after the decompression of the pressure medium. At a further opening of the valves, the pistons 46 are moved in return stroke by the plunger pistons 53 over the yokes 55, the guide rods 54 and the front plate 47 into their initial starting position predetermined by the position of the valve lifters 58.

We claim:

1. A forging apparatus comprising:

a support;

at least one tool-bearing slide on said support formed with a piston having a closed end provided with a forging tool and at least partially hollow and open toward an opposite end of said piston;

a cylinder on said support in which said piston is guided, said cylinder having a cylinder lid at said opposite end of said piston, said cylinder lid being provided with a passage delivering a hydraulic medium to said cylinder and an interior of said piston, and with an outlet for said hydraulic medium;

a valve seat formed in said piston;

an axially displaceable tubular valve lifter guided on said cylinder lid, extending into said piston and engageable with said valve seat, said valve lifter forming with said valve seat a valve closing communication between said cylinder and said outlet, said valve lifter being provided with side channels in said cylinder lid for connection with a chamber surrounding said valve lifter and communicating with said outlet, said valve lifter controlling flow between said passage and said outlet, said chamber being maintained without pressure by said outlet; and an actuator connected with said valve lifter for operating same.

2. A forging apparatus comprising:

a support;

at least one tool-bearing slide on said support formed with a piston having a closed end provided with a forging tool and at least partially hollow and open toward an opposite end of said piston;

a cylinder on said support in which said piston is guided, said cylinder having a cylinder lid at said opposite end of said piston, said cylinder lid being provided with a passage delivering a hydraulic medium to said cylinder and an interior of said piston, and with an outlet for said hydraulic medium;

a valve seat formed in said piston;

an axially displaceable tubular valve lifter guided on said cylinder lid, extending into said piston and engageable with said valve seat, said valve lifter forming with said valve seat a valve closing communication between said cylinder and said outlet, said valve lifter being provided with side channels in said cylinder lid for connection with a chamber surrounding said valve lifter and communicating with said outlet, said valve lifter controlling flow between said passage and said outlet, said chamber being maintained without pressure by said outlet;

an actuator connected with said valve lifter for operating same, the piston being a plunger piston formed at said closed end with a tool-bearing upper plate; and guide rods guiding said upper plate on said support and further pistons on said support and acting upon said guide rods for pulling back said upper plate upon displacement of said tool-bearing slide in a forging operation.

3. The forging apparatus defined in claim 2 wherein said support includes an upper traverse provided with four of said guide rods connected in pairs above said traverse by respective yoke pieces, the pistons for pullback of said plate being braced between said yoke pieces and said traverse.

4. The forging apparatus defined in claim 3 wherein the pullback pistons are constantly acted upon by said hydraulic medium from an accumulator to maintain them inactive during forging operations.

* * * * *